US005544689A

United States Patent [19]

Wegner

[11] Patent Number: 5,544,689

[45] Date of Patent: Aug. 13, 1996

[54] WINDOW ATTACHMENT SCREEN SYSTEM

[76] Inventor: Gary D. Wegner, N.30 W.28706 Lakeside Rd., Pewaukee, Wis. 53072

[21] Appl. No.: 318,197

[22] Filed: Oct. 5, 1994

Related U.S. Application Data

[63] Continuation of Ser. No. 62,999, May 17, 1993, abandoned.

[51] Int. Cl.[6] ..... A47H 1/00

[52] U.S. Cl. ..... 160/100; 160/313; 160/323.1

[58] Field of Search ..... 160/100, 27, 28, 160/323.1, 313, 23.1, 98, 99, 191

[56] References Cited

U.S. PATENT DOCUMENTS

| | | | |
|---|---|---|---|
| 510,336 | 12/1893 | Felthousen | 160/271 |
| 808,400 | 12/1905 | Parsons | 160/267 |
| 975,146 | 11/1910 | Manelius | 160/313 X |
| 998,006 | 7/1911 | Hutchison | 160/271 |
| 1,038,138 | 9/1912 | Hikes | 160/27 X |
| 1,088,139 | 2/1914 | Fischer | 160/273 |
| 1,143,863 | 6/1915 | Schenk | 160/271 |
| 1,184,305 | 5/1916 | Benko | 160/271 |
| 1,240,768 | 9/1917 | O'Neill | 160/313 |
| 1,241,425 | 9/1917 | Nelson | 160/264 |
| 1,317,579 | 9/1919 | Johnson | 160/264 |
| 1,338,223 | 4/1920 | Heath | 160/100 |
| 1,370,500 | 3/1921 | Jones | 160/23 |
| 1,583,133 | 5/1926 | Fierman | 160/264 |
| 1,844,599 | 2/1932 | Renzetti | 160/28 |
| 1,873,156 | 8/1932 | Seide | 160/23 |
| 1,878,710 | 9/1932 | Watson | 160/313 |
| 1,880,589 | 10/1932 | Traut | 160/271 |
| 1,885,756 | 11/1932 | Norquist et al. | 160/271 |
| 1,934,103 | 11/1933 | Traut | 160/23 |
| 1,942,308 | 1/1934 | Renzetti | 160/28 |
| 2,131,521 | 9/1938 | Nye | 160/23 |
| 2,514,274 | 7/1950 | Zagrodny | 160/27 |
| 2,575,128 | 11/1951 | Renzetti | 160/28 |
| 3,179,161 | 4/1965 | Johnson | 160/313 |
| 3,448,943 | 6/1969 | Herou | 160/313 |
| 4,006,770 | 2/1977 | Ferguson | 160/323.1 X |
| 4,009,745 | 3/1977 | Erpenbeck | 160/323.1 X |
| 4,359,081 | 11/1982 | Brower | 160/28 X |
| 4,390,054 | 6/1983 | Niibori et al. | 160/265 |
| 4,638,844 | 1/1987 | Hayashiguchi | 160/23 |
| 4,651,940 | 3/1987 | Nakamura | 160/310 |
| 4,658,879 | 4/1987 | Van Klompenburg | 160/278 |
| 4,671,557 | 6/1987 | Lemp | 160/323.1 X |
| 4,702,297 | 10/1987 | Van Klompenburg | 160/278 |
| 4,741,488 | 5/1988 | Futagawa | 242/107 |
| 4,825,921 | 5/1989 | Ritger | 160/271 |
| 4,834,160 | 5/1989 | Becker | 160/265 |
| 4,935,987 | 6/1990 | Sterner | 49/445 X |
| 5,044,417 | 9/1991 | Bresson | 160/310 |
| 5,099,905 | 3/1992 | Ritger | 160/271 |
| 5,119,591 | 6/1992 | Sterner et al. | 49/445 X |

OTHER PUBLICATIONS

Pp. 77 and 78 of the SPEC catalog by Associated Spring Raymond Co., copyright 1992 by Barnes Group Inc.

Four pages of the Constant–Force Springs report by Associated Spring Co., no date available.

Nine page report by F. A. Votta, Jr., on Constant–Force spring elements submitted to the American Society of Mechanical Engineers on Jun. 11, 1951.

P. 22 of Pella Corporation pamphlet entitled "Window Scaping", copyright 1992 by Pella Corporation.

P. 122 of a hard cover book by the Pella Corporation entitled "World of Windows", copyright 1991 by Rolscreen Co.

Front and back of a single page flyer entitled "The Pella Rolscreen", copyright 1985 by the Rolscreen Company.

*Primary Examiner*—David M. Purol

*Attorney, Agent, or Firm*—David George Johnson

[57] ABSTRACT

A window attachment screen system using a roller screen assembly provides out of view storage of a screen material (16). The screen material (16) is attached to the sash (44) of a double hung or similar window. Operation of the screen material (16) is caused by movement of the window. The roller screen assembly utilizes a constant force spring (34) which resists increases in the torsional loading force.

7 Claims, 4 Drawing Sheets

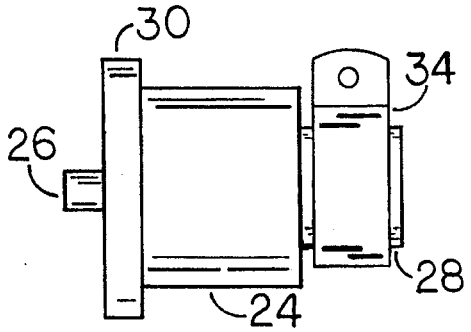
FIG.3-A
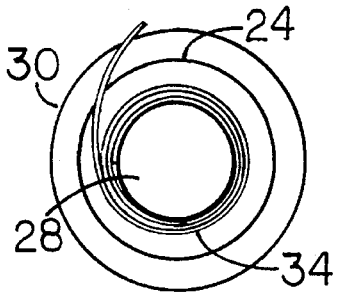
FIG.3-B
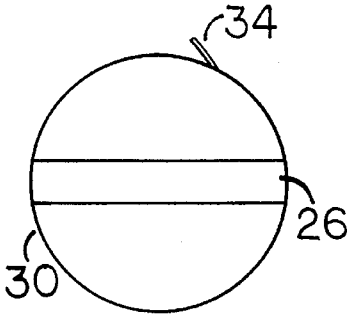
FIG.3-C
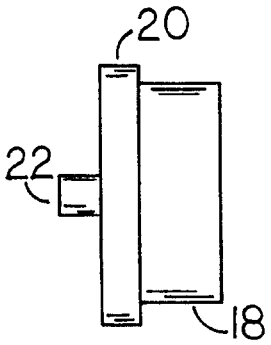
FIG.4-A
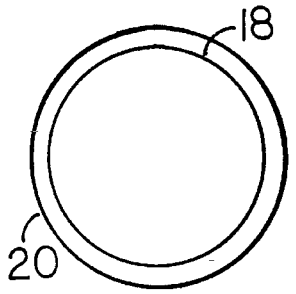
FIG.4-B
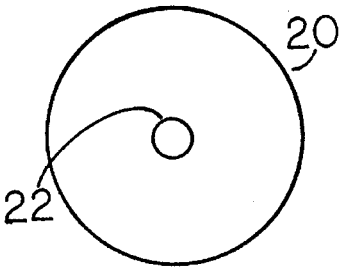
FIG.4-C

WINDOW ATTACHMENT SCREEN SYSTEM

This application is a continuation of application Ser. No. 08/062,999, filed on May 17, 1993, now abandoned.

BACKGROUND OF THE INVENTION

The present invention relates to a roller screen and more particularly to a window attachment screen system providing out of view storage of a window screen so as to permit a previously unknown method of use.

DESCRIPTION OF THE RELATED ART

The application of window screens known to this point in time has been primarily comprised of framing a screen material and subsequently mounting that frame over a window.

A person that may desire a clear, unobstructed view through a window has previously, had to remove the framed screen. Although these screens are generally removable and not a permanent component of most window assemblies, the removal of window screens has been inconvenient. Providing storage for the framed screen so as to prevent damage to the screen and, simultaneously, keep this screen available for ready use has been difficult. Indeed, this method has been so impractical that it is generally not even used on windows that are closed a majority of the time.

Given the advanced state-of-the-art that window manufacturers have attained in clarity it is only natural that a consumer would not wish to inhibit his or her view with a window screen that obstructs up to 40% of available light.

Although some applications of roller screens have been produced, these roller screens have fallen short of solving the aforementioned problem. Previous roller screens have been expensive and combersome articles. The excessive weight and size requirements of electrical motors and complex metal winding mechanisms, for example, that have been the embodiment of related art, have made most actual applications impractical.

One major difficulty that industry has not yet overcome is that of excess torsional force. This is a load force that builds up within the coils of the helical compression springs common in the related art. When the roller screen is pulled down this force builds up to very high levels. So high, in fact, that many would be consumers find it uncomfortable to pull the roller screen down. Another difficulty associated with this excess torsional force is rapid retraction of the roller screen. The loading force builds up in the coils of the compression spring while the roller screen is being pulled down. This loaded force then causes the roller screen to retract so rapidly that it has actually startled some operators. The excess force inherent with the related art certainly limits the scope of installations in which application is practical, and in some cases even possible.

Importantly, previous roller screens have not been designed as a window attachment system but rather as their own separate entity, to be applied over a window. Commonly, the roller screen is housed above the window with this housing being visible to persons inside the room. The screen must be first reached and then pulled down by hand. Furthermore, this device is commonly available only on casement windows. Due in part to high costs associated with the related art, consumers rarely purchase these devices.

In practice, the related art does not address the same problem and concerns as does the present invention as no like attachment system now exists.

SUMMARY OF THE INVENTION

It is a primary object of the present invention to provide a heretofore unknown method for the application of a roller screen. This new system provides for the attachment of a screen material directly to a window sash of a double hung or similarly operating window. It therefore provides for the operation of the screen simply with the movement of this window. The present invention also provides for out-of-view storage of the screen material while the window is in the closed position, thus providing the user a clear and unobstructed view.

A further object of the present invention is to eliminate the excess torsional force built up in helical compression springs of the related art. This is accomplished with the application of a constant-force spring, therefore eliminating the need for a helical compression spring. The constant-force spring is extended, more accurately termed deflected, while itself resisting the loading force associated with a compression spring. Thus, the present invention provides for a nearly constant torsional force with no load build up. This provides for previously unknown ease of use thus allowing for heretofore unknown applications of a roller screen. In fact, the primary object of the present invention is aided by the use of the constant-force spring. This spring makes possible retraction of the screen material without itself pulling the window closed.

Accordingly, several ensuing advantages of my invention are to provide for a new inexpensive roller screen assembly. This new system is not cost prohibitive to either manufacturers or the public.

Furthermore, this new system aids consumers in the cleaning of double hung or similarly operating windows, including those with tilt sashes. This is accomplished by providing for a mere unfastening of the screen material from the window sash. The unfastening can be performed from inside the room, thus eliminating the need for a person to remove a framed screen. Often these screens are mounted on the outside of a window, and many times, on the second floor or higher.

Also, replacement of a damaged screen could be done easily. The compact size of the new roller drum allows for the drum to be mounted within the window frame, therein behind a molding. Wood moldings are generally installed around the inside edges of a window for finishing purposes. After removal of a molding, the roller drum can be easily removed and a replacement screen attached. As the present invention provides for a simple mechanism this can be accomplished by a consumer without the need for special skills or tools.

Additionally, the materials preferred for construction of the present invention provide for a very durable device. The components are not subject to corrosion or wear which normally results from a lack of lubrication. Also, the constant-force spring has a proven reliability of many tens of thousands of cycles without failure.

BRIEF DESCRIPTION OF THE DRAWINGS

In the drawings, closely related figures have the same number but different alphabetic suffixes.

FIG. 3-A is a side elevation view of the spring-roller bushing with the constant-force spring mounted thereon.

FIG. 3-B is an interior elevation view of the spring-roller bushing with the constant-force spring mounted thereon.

FIG. 3-C is an exterior elevation view of the spring-roller bushing with the constant-force spring mounted thereon.

FIG. 4-A is a side elevation view of the fixed bushing.

FIG. 4-B is an interior elevation view of the fixed bushing.

FIG. 4-C is an exterior elevation view of the fixed bushing.

Figure 1:
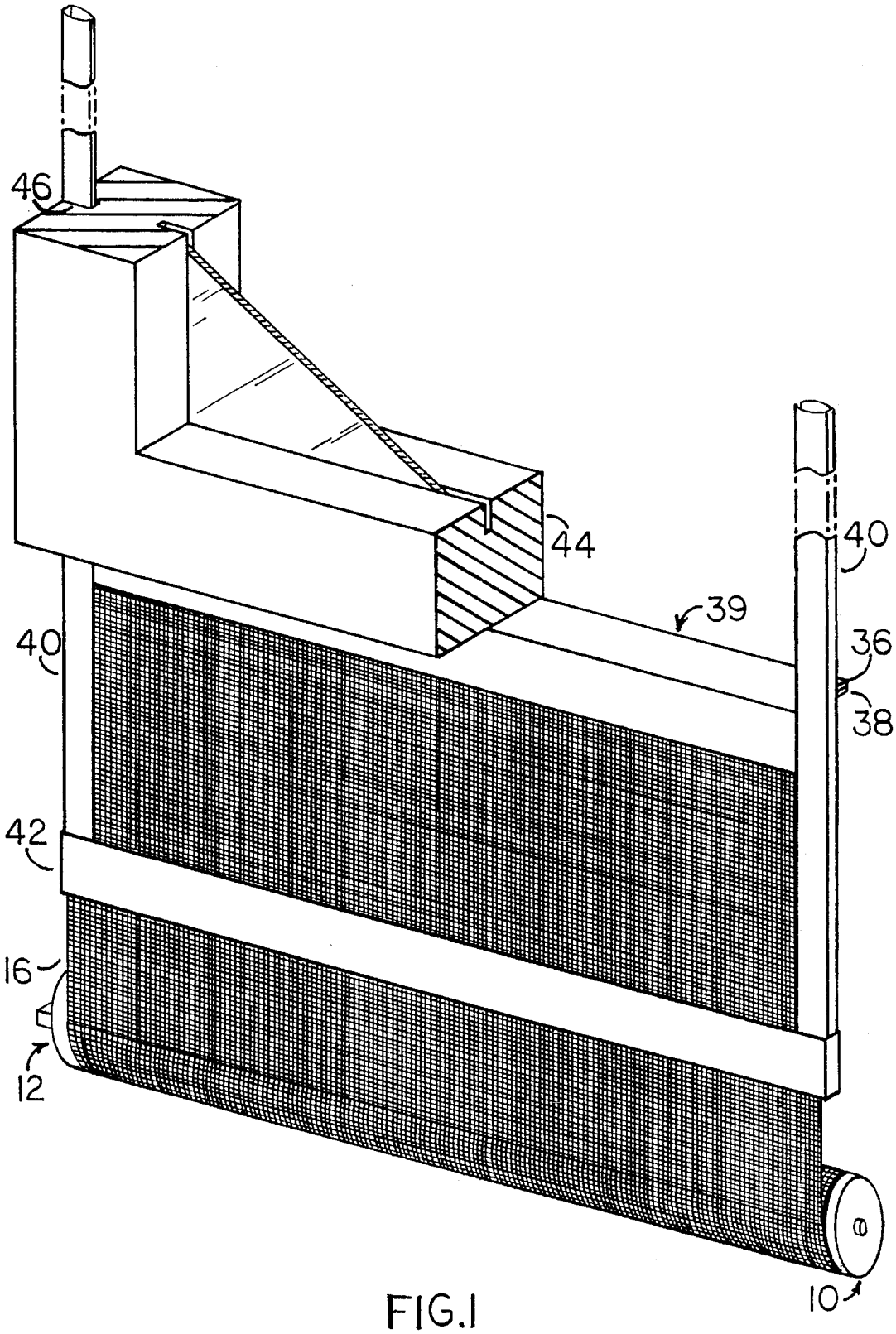
FIG. 1 shows a perspective view of a basic version of the window attachment screen system.

| Reference Numerals In Drawings | |
|---|---|
| 10 fixed bushing | 12 spring-roller bushing |
| 14 roller drum | 16 screen material |
| 18 fixed bushing seat | 20 fixed end cap |
| 22 roller shaft | 24 roller race |
| 26 key | 28 spring spindle |
| 30 roller end cap | 32 spring-mounting pin |
| 34 constant-force spring | 36 inner sash attachment bracket |
| 38 outer sash attachment bracket | 39 sash attachment assembly |
| 40 sash sleeve | 42 sill sleeve |
| 44 window sash | 46 groove in window sash |

DESCRIPTION OF THE PREFERRED EMBODIMENT

The present invention will now be described in detail with reference to the drawings. Shown in FIG. 1 is a screen material 16, which is of a sturdy nature and is attached at one end to a roller drum 14, preferably by an adhesive tape material. The screen material 16 is wrapped around the roller drum 14 so as to allow for at least 1½ wraps of material to remain on roller drum 14 when the screen material 16 is fully deployed. Roller drum 14 may be mounted and housed either horizontally or vertically as further embodiments may require.

As shown in FIG. 1, when screen material 16 is deployed the side edges thereof are contained within sash sleeves 40. Accordingly, sash sleeves 40 provide stability to the extended screen material 16. Sash sleeves 40 additionally ensure the effectiveness of screen material 16 as an insect barrier by providing for edges which close toward each other thus sandwiching the screen material 16. This pinching to be accomplished with adequate pressure to secure against insects but without sufficient force to wear or damage the screen material 16 as it is subsequently deployed and retracted. Sash sleeves 40 are attached to the window frame or jambs in a manner compatible with the particular materials comprising the frame or jambs. Furthermore, sash sleeve 40 is provided with a groove in window sash 46 so as to permit movement of window while sash sleeve 40 remains stationary. Preferably, the sash sleeves 40 protrude somewhat past the full opening point at which the sash attachment assembly 39 ultimately reaches. Transversly, the other end of the sash sleeves 40 should terminate within the sill sleeve 42.

Figure 2:
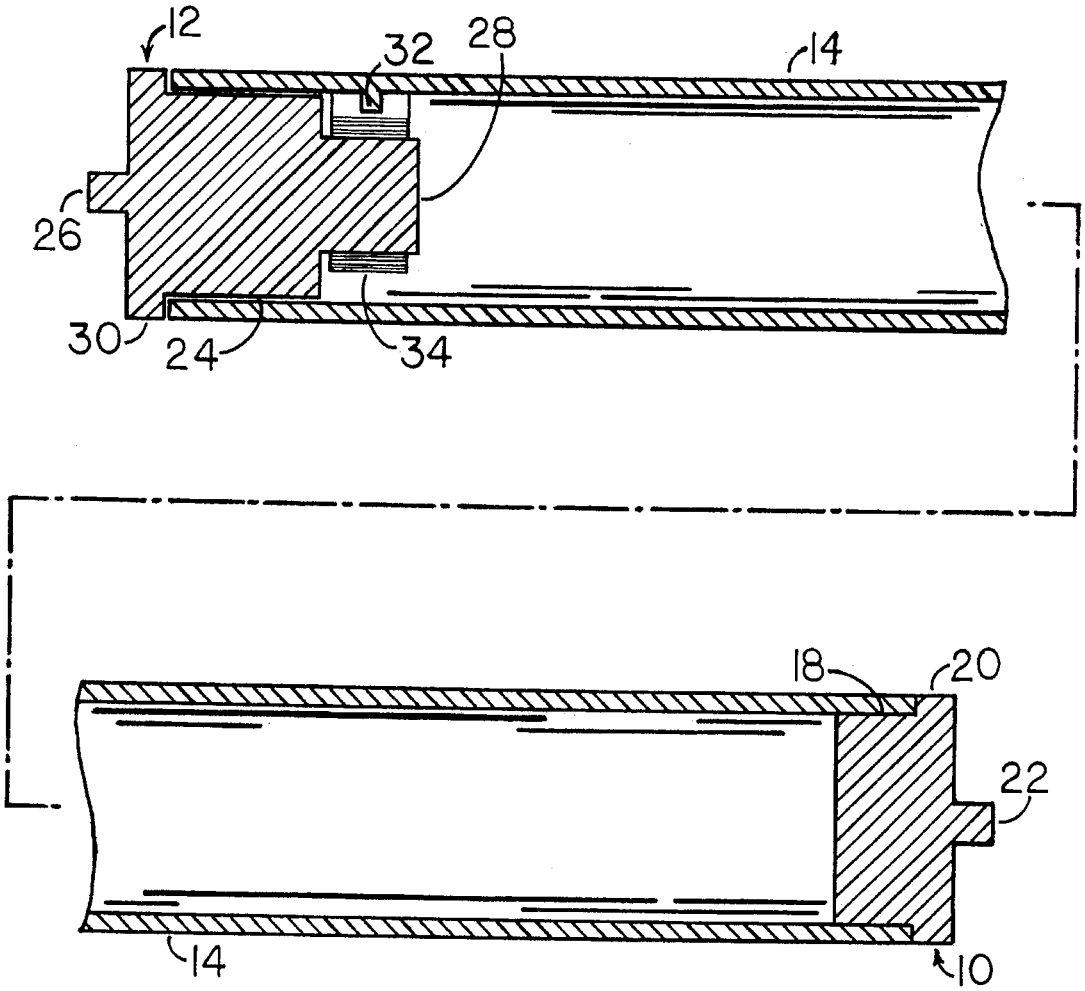
FIG. 2 is a longitudinal sectional view of the roller drum assembly.

Presented in FIG. 2 is roller drum 14, to be comprised of a hollow pipe-like structure and constructed of a material which is of adequate strength so as to resist bending or flexing during deployment of the screen material 16. Such material also is of a non-corrosive nature and ultimately lightweight. The preferred material for construction of the roller drum 14 being schedule 40 polyvinyl chloride, commonly known as schedule 40 PVC. Schedule being a designation of pipe wall thickness. This and other specifications of polyvinyl chloride are maintained by the ASTM, American Society of Testing and Materials. Also shown sectionally in FIG. 2 are the fixed bushing 10 and the spring roller bushing 12. Both bushings are constructed of the same material as is roller drum 14. Clearly shown is the junction between fixed bushing 10 and roller drum 14, such a junction is made permanent, preferably by use of an adhesive, such as a solvent cement process. FIG. 2 also shows sectionally an embodiment of a spring-roller bushing 12. Apparent is the differential between the inside diameter of roller drum 14 and outside diameter of the roller race 24 portion of spring-roller bushing 12. Thus, a slight gap is provided circumferentially between roller drum 14 and roller race 24. Additionally, shown in FIG. 2 is an embodiment of constant-force spring 34. The constant-force spring 34, which wraps tightly upon itself, is attached at its outer end to the roller drum 14. As embodied a spring-mounting pin 32 is provided wherein a hole located near the outer end of constant-force spring 34 tightly fits over the end of and subsequently on to spring-mounting pin 32 thus securing said spring to roller drum 14.

FIGS. 3-A, 3-B, and 3-C more directly show the preferred embodiment of spring-roller bushing 12. As stated previously it is preferred that the spring-roller bushing 12 be constructed of PVC. The material to be cast in such a manner as to form all portions and components of the spring-roller bushing 12 in one, unseparated piece.

Clearly shown is the relationship between the constant-force spring 34 and the mounting apparatus, embodied as spring spindle 28. Also shown within the drawings presented is key 26. The key 26 is designated to maintain spring roller-bushing 12 at a fixed position and mount one end of roller drum 14 to a window frame or jamb. A slot to accomodte key 26 is provided at the window frame or jamb.

FIGS. 4-A, 4-B, and 4-C more directly show the preferred embodiment of fixed bushing 10. As state previously it is preferred that the fixed bushing 10 be constructed of PVC. The material to be cast in such a manner as to form all portions and components of the fixed bushing 10 in one, unseparated piece.

Clearly shown is roller shaft 22. The roller shaft 22 is designated to maintain the position of one end of roller drum 14 while allowing the same to rotate. A receptacle to accommodate roller shaft 22 is provided at the window frame or jamb.

Figure 5:
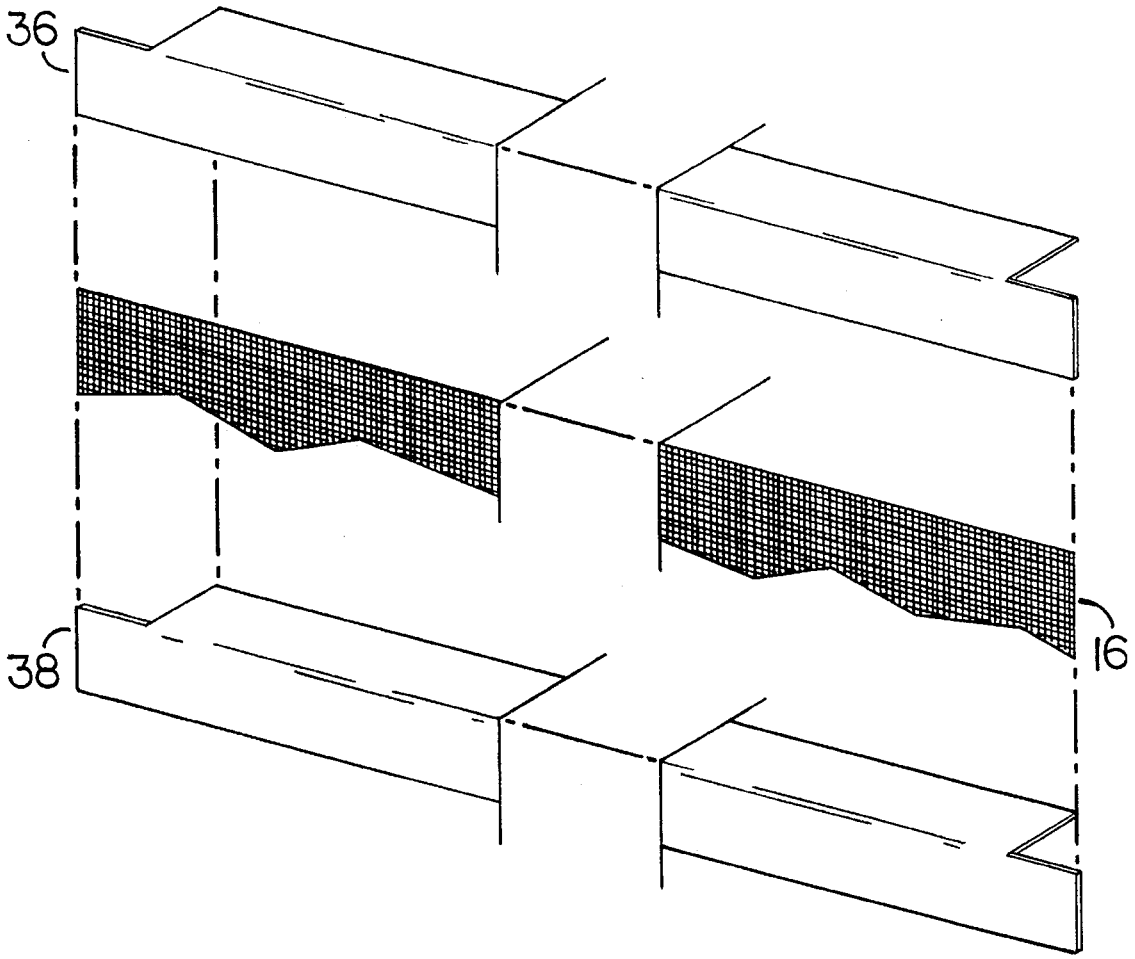
FIG. 5 is a perspective view showing projection of the sash attachment bracket components.

Referring now to FIG. 5, an embodiment of the sash attachment assembly 39 is shown. As embodied the screen material 16 is sandwiched between an inner sash attachment bracket 36 and an outer sash attachment bracket 38. The screen material 16 therein sandwiched and held secure with the aid of an adhesive. Accordingly, means for attaching the sash attachment assembly 39 to the sash is provided. Some possible means for accomplishing this attachment vary from simple screws to, preferably, a stab and slide-to-lock post design which provides for a quick unfastening method for consumers.

Figure 6:
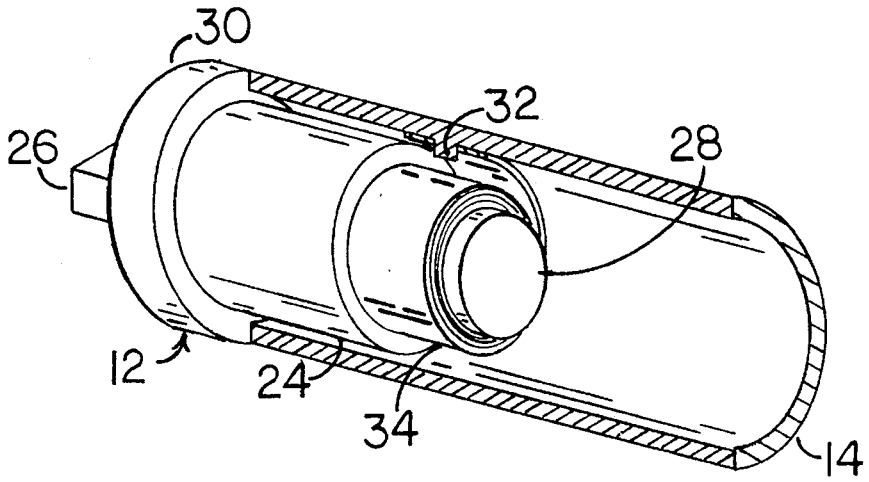
FIG. 6 is a perspective view of the spring-roller bushing within a sectional view of the roller drum.

In the perspective view presented as FIG. 6 the relationship between spring-roller bushing 12, with reference to spring spindle 28, and the constant-force spring 34 can more clearly be seen. Furthermore, the mounting of constant-force spring 34 onto spring-mounting pin 32 is distinctly shown.

Now the operation and usage of the window attachment screen system will be explained, with reference to the embodiment presented in FIG. 1 of the drawings.

The manner of utilizing the window attachment screen system is unlike that of any related art. In order to use this new system a consumer must only operate the window to which this system is attached. Opening of the window causes the screen material 16 to be raised, thus filling the opening therein created. This being accomplished due to the attachment of screen material 16 to sash attachment assembly 39 which, in turn, is itself attached to the window sash 44. Therefore, a consumer need not perform any additional task to provide an insect barrier aside from the basic operation of the window. As this window is opened and the exposed area of screen material 16 is enlarged, stability is provided to the sides of the screen material 16. This is accomplished through the containment of the edges of screen material 16 within the sash sleeves 40.

As this window opening operation is occuring, the required screen material 16 is unrolled from below the sill, being protected during its travel through the sill by sill sleeve 42. Below the sill is found roller drum 14. Roller drum 14 being simultaneously held in fixed position and allowed to rotate longitudinaly by use of a bushing at each end. At one end, fixed bushing 10 allows for the mounting to the window frame or jamb through roller shaft 22. At the other end of the roller drum 14 mounting to the window frame or jamb is accomplished through spring-roller bushing 12. Particularly, this mounting occurs to the window frame or jamb by use of key 26.

Rotation of the roller drum 14 is made possible therefore by the rotation of fixed bushing 10 on roller shaft 22 and by the rotation of roller drum 14 on the roller race 24 portion of spring-roller bushing 12.

An important operational component of the window attachment screen system is constant-force spring 34. The constant-force spring 34 consists of a spiral of strip material with built-in curvature. Each turn of the strip material wraps tightly on its inner neighbor. The inherent stress of this strip material resists loading force at a nearly constant rate. Connecting the roller dram 14, at spring-mounting pin 32, to the spring-roller bushing 12, at spring spindle 28, by means of the constant-force spring 34 causes several actions to occur. One of these actions is to keep the screen material 16 taught while deployed. Another of these actions is to retrieve the screen material 16 upon the roller drum 14 when the window system it is attached to is closed. Both actions are accomplished without having to overcome the excess load force inherent in the related art.

Furthermore, the window remains open without the application of an extraneous device. The nature of the constant-force spring 34 provides for this on windows with even a minimal resistance to movement.

This application is, therefore, intended to cover any variations, uses, or adaptations of the invention following the general principles thereof and including such departures from the present disclosure as come within known or customary practice in the art to which this invention pertains and fall within the limits of the appended claims.

What is claimed is:

1. A screen mounting system, comprising:

(a) a flexible screen material, at least a portion of the flexible screen material residing within a first plane, the flexible screen material having a free edge and a captive edge;

(b) a drum, the drum having a perimeter surface, a first diameter and a first longitudinal axis, the drum being mounted so as to be rotatable about the first longitudinal axis, the drum being mounted so that the perimeter surface is tangential to the first plane;

(c) a constant force spring, the constant force spring imparting a substantially constant torsional force to the drum, thereby biasing the drum to rotate about the first longitudinal axis at a substantially constant angular acceleration; and (d) a drum end cap, the drum end cap comprising:

(i) a first region, the first region being a key, the key being shaped so as to be rigidly retained within a mating fitting external to the drum;

(ii) a second region, the second region being integrally formed with the first region, the second region having a second diameter and a second longitudinal axis, the second diameter being substantially equal to the first diameter of the drum, the second region being mounted in a spaced apart relationship from a first end of the drum, the second longitudinal axis being coaxial with the first longitudinal axis;

(iii) a third region, the third region being integrally formed with the second region, the third region having a third diameter, the third diameter being less than the first diameter such that the third region fits within an interior region of the drum in a spaced apart relationship; and (iv) a fourth region, the fourth region being integrally formed with the third region, the fourth region having a fourth diameter, the fourth diameter being less than the third diameter, a first end of the constant force spring being rigidly affixed to the fourth region so as to impart a torsional biasing force to the drum.

2. The screen mounting system of claim 1, further comprising a pin, the pin being rigidly mounted within an interior region of the drum, the pin being adapted to retain a second end of the constant force spring, thereby creating a torsional bias between the drum and the drum end cap.

3. The screen mounting system of claim 2, wherein the drum and the drum end cap are composed substantially of polyvinyl chloride.

4. The screen mounting system of claim 3, further comprising a sill sleeve, the sill sleeve being rigidly mounted within a window sill, the sill sleeve guiding the flexible screen material so as to retain the flexible screen material within the first plane.

5. The screen mounting system of claim 4, further comprising a fixed bushing, the fixed bushing being rigidly affixed to a second end of the drum, the fixed bushing being rotatably mounted to a fitting external to the drum.

6. The screen mounting system of claim 5, further comprising a sash attachment bracket, the sash attachment bracket being rigidly affixed to the free end of the flexible screen material, the sash attachment bracket being affixed to a window sash such that moving the window sash causes the flexible screen material to translate within the first plane.

7. The screen mounting system of claim 6, further comprising at least one sash sleeve, the sash sleeve being rigidly affixed to and substantially perpendicular to the sill sleeve, the sash sleeve guiding the flexible screen material within the first plane.

* * * * *